US007484620B2

(12) United States Patent
Miller et al.

(10) Patent No.: US 7,484,620 B2
(45) Date of Patent: Feb. 3, 2009

(54) ACCESSORY STORAGE CASE

(75) Inventors: Mark D. Miller, Airville, PA (US); Michael P. Peters, Lutherville, MD (US); Rickey J. Thomas, Manchester, MD (US); Mark E. Brunson, Bel Air, MD (US); Don C. Freeman, Havre De Grace, MD (US)

(73) Assignee: Black & Decker Inc., Newark, DE (US)

( * ) Notice: Subject to any disclaimer, the term of this patent is extended or adjusted under 35 U.S.C. 154(b) by 494 days.

(21) Appl. No.: 11/273,611

(22) Filed: Nov. 14, 2005

(65) Prior Publication Data

US 2007/0108076 A1 May 17, 2007

(51) Int. Cl.
*B65D 85/20* (2006.01)

(52) U.S. Cl. ..... 206/379; 206/443; 220/8

(58) Field of Classification Search ..... 206/349, 206/354, 372, 373, 379, 443; 220/8
See application file for complete search history.

(56) References Cited

U.S. PATENT DOCUMENTS

| | | | | |
|---|---|---|---|---|
| 695,660 | A | 3/1902 | Swan | |
| 883,906 | A | 4/1908 | Swan | |
| 1,450,674 | A * | 4/1923 | Marston | 220/8 |
| 1,934,138 | A | 11/1933 | Paul et al. | |
| 2,256,257 | A | 9/1941 | Dukehart, Jr. | |
| 2,670,842 | A | 3/1954 | Kruft | |
| 2,827,004 | A | 3/1958 | Luce et al. | |
| 3,072,244 | A | 1/1963 | Smith | |
| 3,265,204 | A | 8/1966 | Wizniak | |
| 3,294,225 | A | 12/1966 | Kenyon | |
| 3,395,787 | A * | 8/1968 | Plaskan | 220/8 |
| 3,454,151 | A | 7/1969 | Plaskan | |
| 3,494,499 | A | 2/1970 | Plog et al. | |
| 3,521,810 | A | 7/1970 | Boyer | |
| 3,621,994 | A | 11/1971 | Brown | |
| 3,817,372 | A | 6/1974 | Smith | |
| 4,046,279 | A | 9/1977 | Rosler | |
| 4,210,253 | A | 7/1980 | Rosler | |
| 4,402,423 | A | 9/1983 | Skowronski et al. | |
| 4,445,611 | A | 5/1984 | Shofu | |
| 4,509,656 | A | 4/1985 | Rosler | |

(Continued)

FOREIGN PATENT DOCUMENTS

| | | |
|---|---|---|
| DE | 21 757 | 8/1961 |

(Continued)

*Primary Examiner*—Luan K Bui
(74) *Attorney, Agent, or Firm*—Harness, Dickey & Pierce, P.L.C.

(57) ABSTRACT

A storage case allows access to the accessories therein regardless of the length of the accessories. The case may be telescopic such that the length of the case may be adjusted to store accessories of various lengths and to facilitate the access to these accessories. The storage case may have fixed dimensions with a slidably removable wall that allows easy access to the accessories stored therein. The storage case may be fixed in dimension and has panels with multiple hinges that allow the different hinges to provide varying degrees of access to the accessories therein. The storage case may be fixed in dimension and have a pivotal sidewall that may be pivoted to allow access to the accessories stored therein.

23 Claims, 6 Drawing Sheets

U.S. PATENT DOCUMENTS

| | | | | | |
|---|---|---|---|---|---|
| 4,596,340 | A | | 6/1986 | Luther | |
| 5,076,428 | A | | 12/1991 | Shaw | |
| 5,509,527 | A | | 4/1996 | Wang | |
| 5,562,212 | A | * | 10/1996 | Rosler | 206/443 |
| 5,680,949 | A | | 10/1997 | Roesler | |
| 5,829,591 | A | | 11/1998 | Lyons | |
| 5,893,457 | A | | 4/1999 | Wei | |
| 5,967,318 | A | * | 10/1999 | Rosler | 206/372 |
| 6,298,857 | B1 | * | 10/2001 | Schmidt | 206/236 |
| 2004/0232016 | A1 | | 11/2004 | Dietrich | |
| 2006/0042980 | A1 | | 3/2006 | Chen | |

FOREIGN PATENT DOCUMENTS

| | | | |
|---|---|---|---|
| DE | 1 927 578 | | 11/1965 |
| DE | 24 31 672 | | 1/1976 |
| DE | 24 31 672 | A1 | 1/1976 |
| DE | GM 76 20 793 | | 10/1976 |
| DE | 3211146 | | 6/1983 |
| DE | 33 25 033 | C2 | 3/1984 |
| DE | 44 30 974 | A1 | 3/1995 |
| DE | 299 04 031 | U1 | 8/1999 |
| FR | 2204488 | | 5/1974 |
| FR | 2797798 | | 2/2001 |
| IT | 1116558 | | 7/2001 |
| WO | WO 94/24008 | | 10/1994 |

* cited by examiner

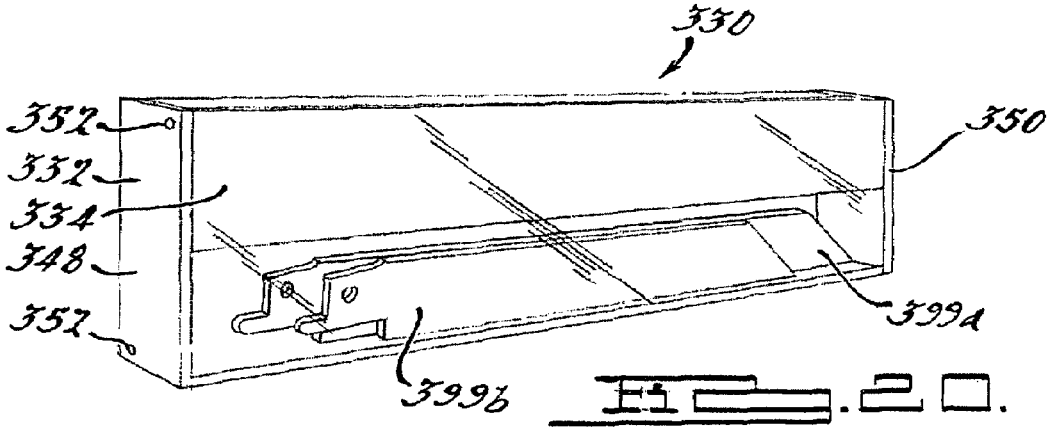
FIG. 20.
FIG. 21.
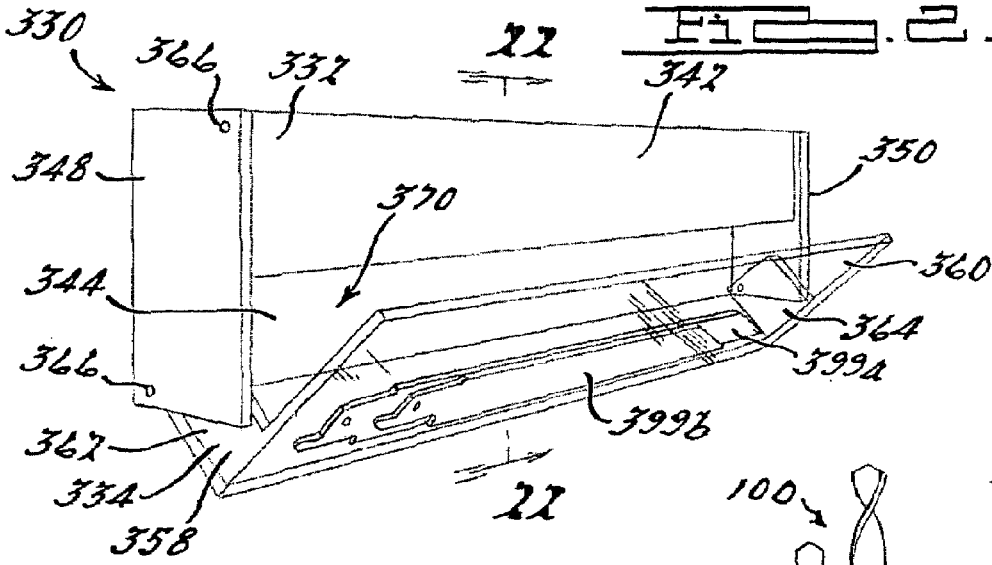
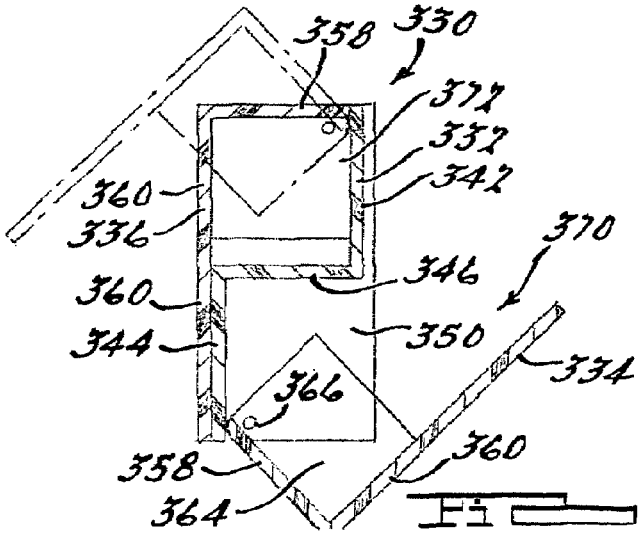
FIG. 22
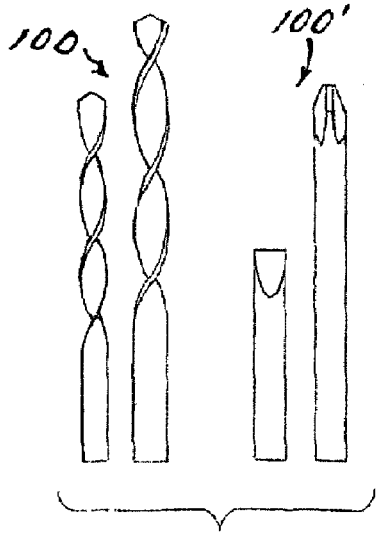
FIG. 23.

ACCESSORY STORAGE CASE

FIELD

The present invention relates to storage cases, and, in particular, storage cases for tool accessories having varying lengths.

BACKGROUND

When utilizing power tools, the accessories or working bits for the tools may be changed out or varied depending upon the operation to which the power tool is being used. These various accessories come in various lengths, sizes and dimensions. For example, the accessories may include saw blades, hammer drill bits, drill bits, jigsaw blades, scroll saw blades, screw driver bits and the like, such as those shown in FIG. 23. The length of the accessories may vary. By way of non-limiting example, some saw blades may be nine inches in length, while other saw blades are six inches in length. It would be desirable to provide a storage case that is capable of storing these accessories having various lengths and sizes. Moreover, it would be advantageous if such a storage case allowed easy and quick access to the accessories regardless of the length or size of the accessory and does not require the accessories to be dumped out to retrieve the shorter accessories. Productivity of the user of the power tool may be enhanced by allowing easy and quick access to the accessories. Additionally, it would be advantageous if such a case were lightweight, compact, durable and economical to manufacture.

SUMMARY

A storage case according to the present teachings advantageously allows access to the accessories therein regardless of the size or shape of the accessories. In one teaching, the case is telescopic such that the length of the case may be adjusted to store accessories of various lengths and to facilitate the access to these accessories. In another teaching, the storage case has fixed dimensions with a slidably removable wall that allows easy access to the accessories stored therein. In another teaching of the present invention, the storage case is fixed in dimension and has panels with multiple hinges that allow the panel to be pivoted about the different hinges thereby providing varying degrees of access to the accessories therein. In yet another teaching of the present invention, the storage case is fixed in dimension and has a pivotable sidewall that may be pivoted to allow access to the accessories stored therein.

Further areas of applicability of the present teachings will become apparent from the detailed description provided hereinafter. It should be understood that the detailed description and specific examples are intended for purposes of illustration only and are not intended to limit the scope of the teachings.

BRIEF DESCRIPTION OF THE DRAWINGS

The present teachings will become more fully understood from the detailed description and the accompanying drawings, wherein:

FIGS. 4-7 are side views of the storage case of FIGS. 1 and 2 in various operable positions and showing the storage of accessories therein;

FIG. 8 is a cross-sectional view along line 8-8 of FIG. 4;

FIG. 20 is a perspective view of a storage case according to the present teachings;

FIG. 21 is a perspective view of the storage case of FIG. 20 with one of the panels open;

FIG. 22 is a cross-sectional view along line 22-22 of FIG. 21 with one panel open and the other panel closed; and FIG. 23 is a plan view of various accessories that may be stored in storage cases of the present teachings.

DETAILED DESCRIPTION

The following description is merely exemplary in nature and is in no way intended to limit the teachings, their application, or uses.

Figure 1:
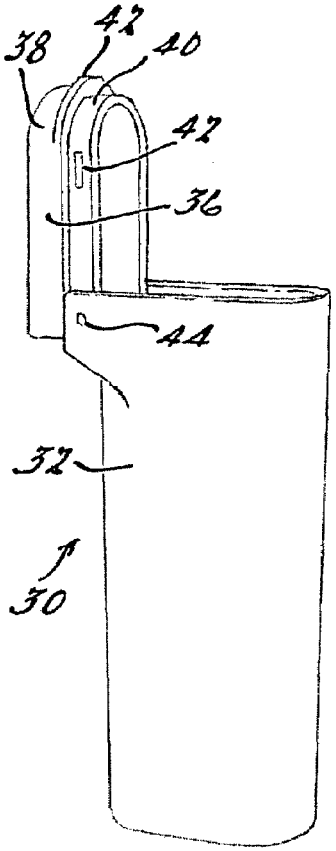
FIGS. 1 and 2 are perspective views of a storage case according to the present teachings in a retracted and extended state, respectively.
Figure 2:
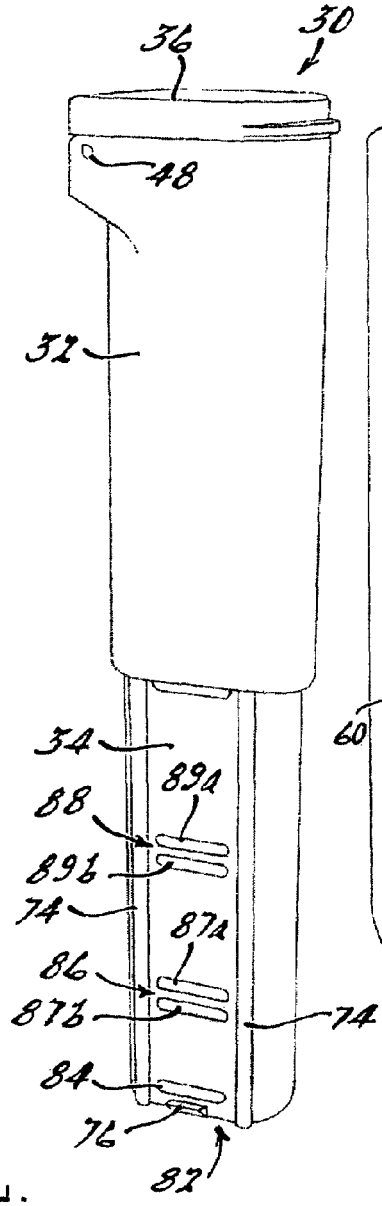
Figure 3:
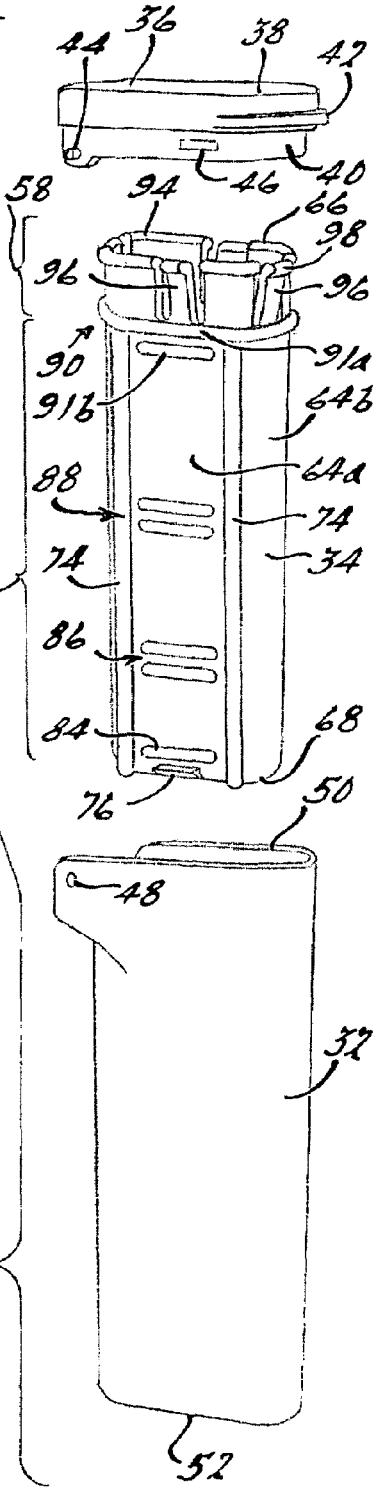
FIG. 3 is an exploded view of the storage case of FIGS. 1 and 2.
Figure 1:
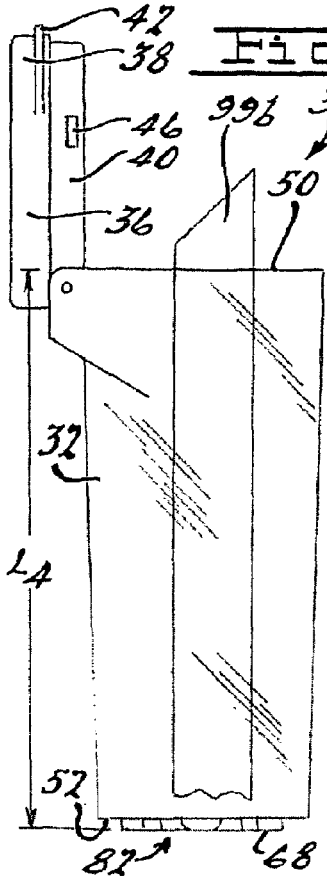
Figure 3:
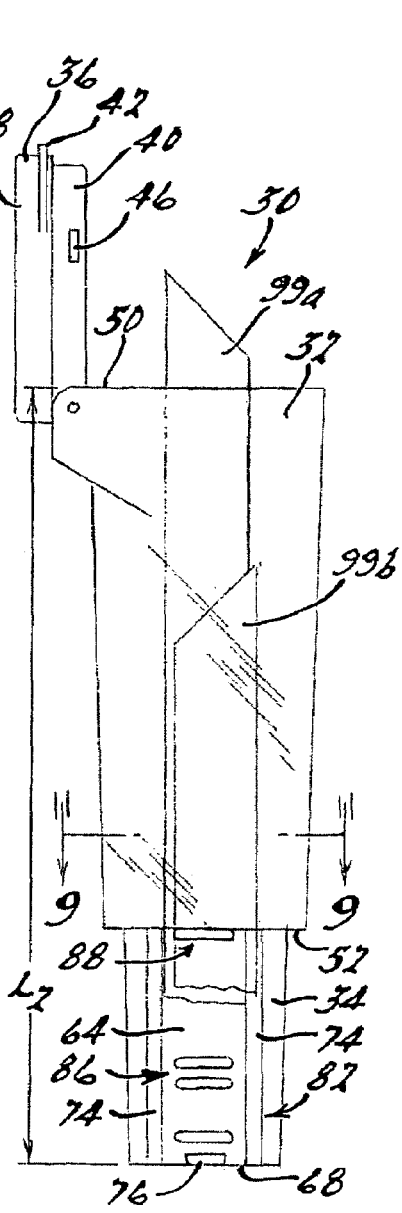

With reference to FIGS. 1-10, a storage case 30 according to the present teachings is shown. Storage case 30 is extendable between a fully retracted position, such as that shown in FIG. 1, a fully extended position, such as that shown in FIG. 2, and various intermediate positions therebetween such as those shown in FIGS. 4-6. Storage case 30 may store accessories of various lengths therein. Such accessories include, by way of non-limiting example, saw blades 99, such as those shown in FIGS. 4-7, and drill bits 100 and screw driver bits 100', such as those shown in FIG. 23, and the like. Storage case 30 includes an outer shell 32 and an inner shell 34 that fits within outer shell 32. Shells 32, 34 are movable or telescopic with respect to one another to change the length of storage case 30. Storage case 30 also includes a lid 36 that attaches to outer shell 32. Lid 36 is movable between an open position, as shown in FIG. 1, and a closed position, as shown in FIG. 2, to allow access to and cover the interior the storage case 30.

Lid 36 can be a single-piece member having an upper portion 38 and a downwardly-extending lower portion 40 that resides within the interior of outer shell 32 when in the closed position. Upper portion 38 includes an outwardly-extending projection or tab 42 that provides a gripping surface that facilitates the opening of lid 36. Lower portion 40 includes outwardly-extending rod-like projections 44 and outwardly-extending projections 46. Projections 46 engage with recesses (not shown) within the interior of outer shell 32 to retain lid 36 in a closed position. Rods 44 engage with apertures 48 in outer shell 32 to provide a pivot about which lid 36 rotates when moving between the open and closed positions. Lid 36 can be made from a variety of materials and may be transparent, translucent or opaque. By way of non-limiting example, lid 36 may be made from polypropylene, ABS, glass-filled polymers, and the like.

Outer shell 32 includes a top edge 50 that engages with the bottom surface of upper portion 38 of lid 36 when lid 36 is in a closed position. Outer shell 32 also includes a lower edge 52. The inner surface 54 of outer shell 32 defines the interior, and is generally smooth and defines an inner diameter of outer shell 32. An inwardly-extending projection 56 is disposed at inner surface 54, adjacent lower edge 52. Projection 56 (shown in FIG. 10) engages with complementary projections on inner shell 34 to retain outer shell 32 in a desired position relative to inner shell 34, as described below. Inner surface 54 may taper due to the drafting associated with molding outer shell 32. The tapering results in the inner diameter of outer shell 32 being smallest adjacent lower edge 52 and largest adjacent top edge 50. A wall thickness of the majority of outer shell 32 is substantially the same. A variety of draft angles may be utilized in manufacturing outer shell 32. For example, outer shell 32 may have a draft angle as small as about 0.5°.

Inner shell 34 has an upper portion 58 and a lower portion 60. Upper portion 60 always resides within outer shell 32. Inner shell 32 has opposite inner and outer surfaces 62, 64, an upper edge 66 and a bottom 68. Inner and outer surfaces 62, 64 may taper as they extend from bottom 68 to upper edge 66 due to the associated draft used when inner shell 34 is molded. As a result, the inner diameter of inner shell 34 is smallest adjacent bottom 68 and greatest adjacent upper edge 66. The thickness of inner shell 34 between inner and outer surfaces 62, 64 is substantially the same or uniform. Bottom 68 and inner surface 62 defines the interior cavity 70 of inner shell 34 within which accessories can be disposed. Outer surface 64 includes both flat portions 64*a* and curved portions 64*b* and numerous features that facilitate the assembly of storage case 30 and the telescopic and positive position retaining functions of storage case 30. Four longitudinally-extending ribs 74 extend along outer surface 64 of lower portion 60 from bottom 68 toward upper edge 66 and merge into outer surface 64 adjacent upper portion 58. Ribs 74 are located at the junction of the flat and curved portions 64*a*, 64*b* of outer surface 64. Ribs 74 are dimensioned to provide a constant exterior dimension of lower portion 58 of inner shell 34 between opposing flat portions 64*a* along its longitudinal length, as shown in FIG. 10B. Ribs 74 are dimensioned to engage with projection 56 on inner surface 54 of outer shell 32. The uniform outer dimension of ribs 74 causes at least one rib 74 to be engaged with projection 56 in all positions of outer shell 32 relative to inner shell 34. As a result, a consistent feel is experienced by a user extending or retracting inner and outer shells 32, 34 relative to one another. The use of ribs 74 to provide the constant exterior dimension to engage with projection 56 on inner surface 54 of outer shell 32 allows outer surface 64 to taper with the tapering of inner surface 62 thereby resulting in a wall thickness that is generally uniform or constant. The ribs eliminate the need for outer surface 64 to form a uniform exterior dimension to engage with projection 56 on inner surface 54 of outer shell 32. As a result, the overall volume or material used to produce inner shell 34 is reduced. That is, if outer surface 64 were to provide a uniform exterior dimension, the wall thickness would be greater adjacent bottom 68 and thinner adjacent upper edge 66. As a result, the material used to form inner surface 62 would need to be increased over that associated with the use of ribs 74 to provide the constant exterior dimension. Thus, the use of ribs 74 reduces the material costs of producing inner shell 34 and results in a more economical storage case 30.

Figure 10A:
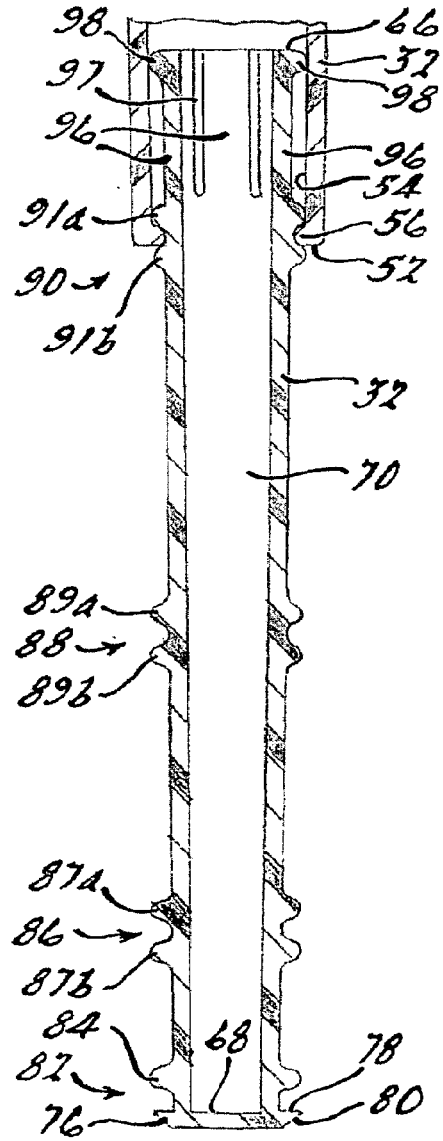
FIGS. 10A and 10B are cross-sectional views along lines 10A-10A and 10B-10B, respectively, of FIG. 8.
Figure 10B:
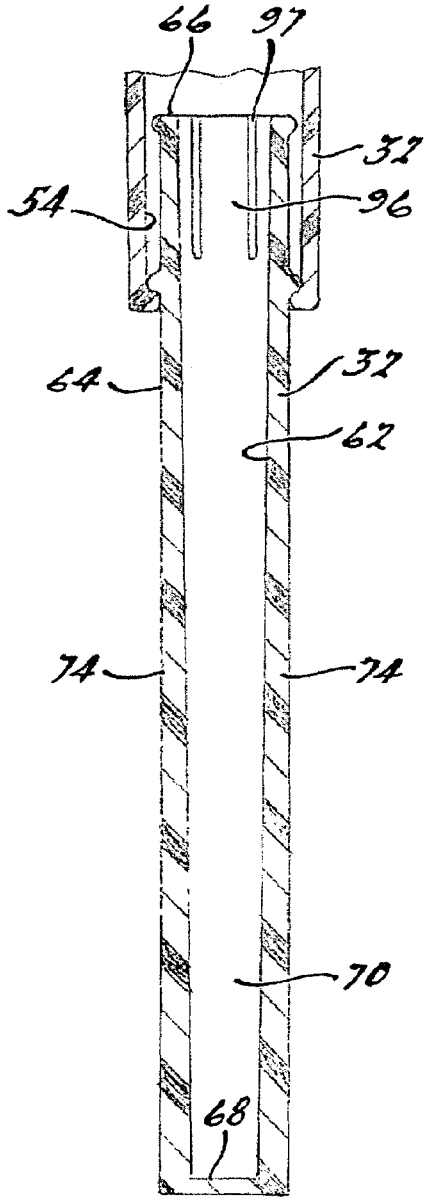
Figure 11:
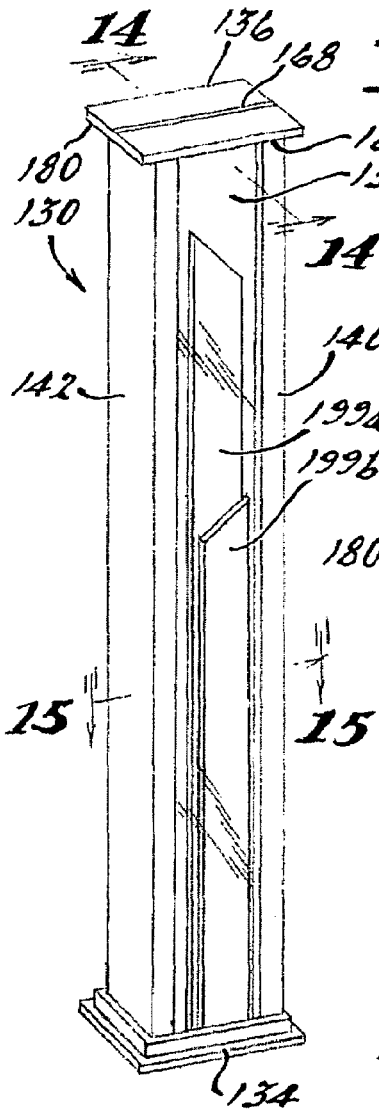
FIG. 11 is a perspective view of a storage case according to the present teachings.
Figure 12:
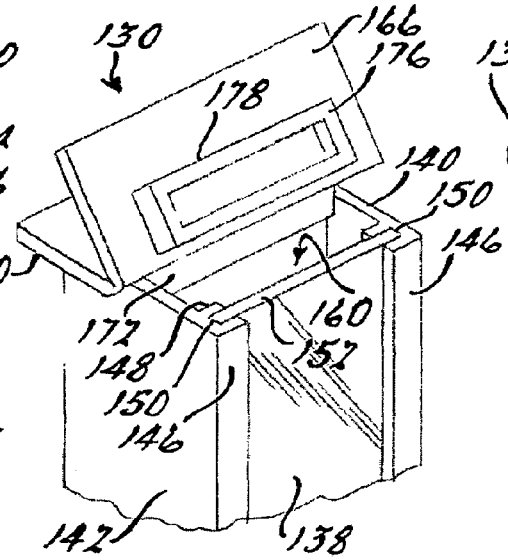
FIG. 12 is a partial perspective view of the storage case of FIG. 11 with one side of the lid open.
Figure 13:
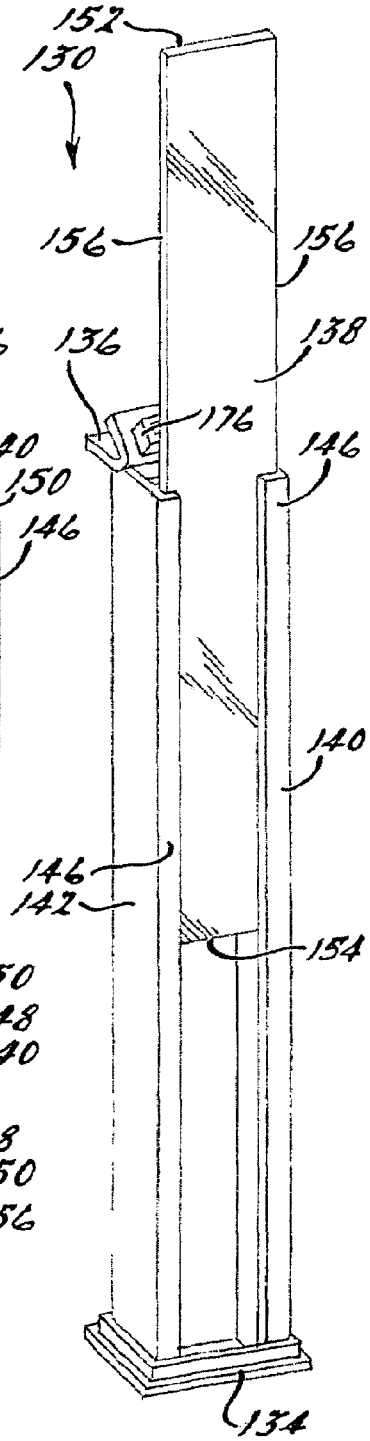
FIG. 13 is a perspective view of the storage case of FIG. 11 with the panel partially removed.
Figure 15:
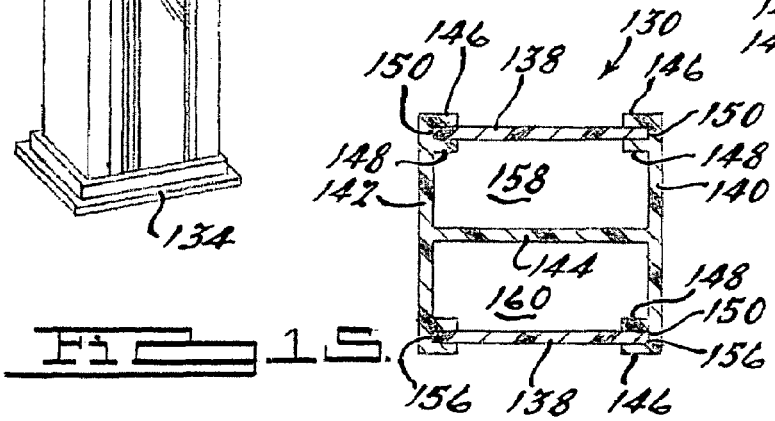
FIG. 15 is a cross-sectional view along line 15-15 of FIG. 11.
Figure 14:
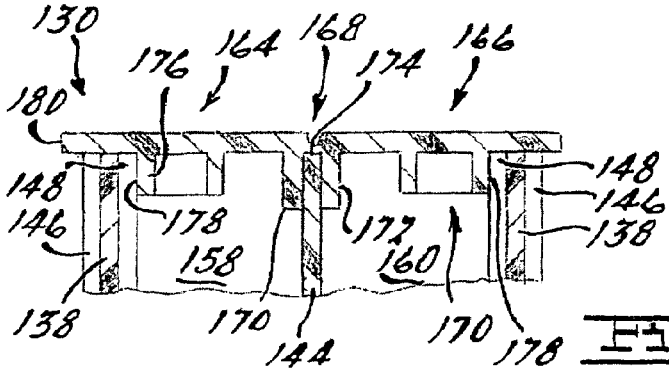
FIG. 14 is a cross-sectional view along line 14-14 of FIG. 11.
Figure 16:
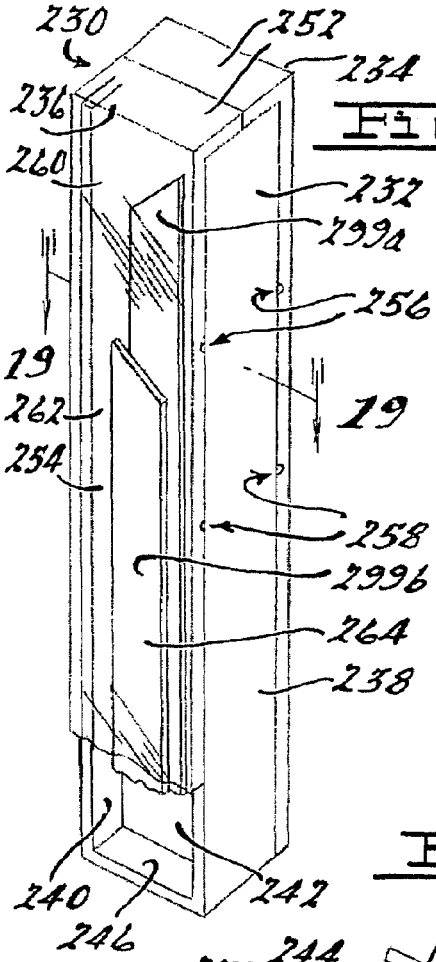
FIG. 16 is a perspective view of a storage case according to the present teachings.

A lower assembly feature 76, as shown in FIG. 10A, projects outwardly from the opposite flat outer surfaces 64*a*, and functions to retain outer shell 32 on inner shell 34 when assembled. Assembly feature 76 includes a generally-flat top surface 78 that extends orthogonally from outer surface 64 and a tapering side edge 80 that tapers inwardly as it extends downwardly. When assembling storage case 30 inner shell 34 is slid into outer shell 32. Tapering side edge 80 engages with projection 56 and, due to the tapering, allows projection 56 to extend over assembly feature 76. The flat top surface 78 prevents projection 56 from moving downwardly relative to inner shell 34 beyond assembly feature 76 thereby inhibiting the removal inner shell 34 from outer shell 32.

A plurality of positive position-retaining features is disposed along outer surface 64 of inner shell 34. The position-retaining features engage with projection 56 on inner surface 54 of outer shell 32 to retain outer shell 32 and inner shell 34 in specific positional relationships while allowing some minor limited relative movement. A first position-retaining feature 82 is formed by an outwardly-extending projection 84 and assembly feature 76. Assembly feature 76 and projection 84 are longitudinally spaced apart such that projection 56 of outer shell 32 can fit therebetween. When projection 56 is disposed between projection 84 and assembly feature 76, relative movement of outer shell 32 relative to inner shell 34 is limited, thereby providing a positively-engaging position-retaining feature. A second position-retaining feature 86 is disposed longitudinally-upward from first position retaining-feature 82. Second position-retaining feature 86 includes longitudinally-spaced-apart projections 87*a*, 87*b* that extend outwardly. Projection 56 of outer shell 32 can be disposed between second position-retaining projections 87*a*, 87*b* to positively retain outer shell 32 relative to the inner shell 34 in a second position. Similarly, a third position-retaining feature 88 is spaced longitudinally-upwardly from second-retaining feature 86. The third position-retaining feature 88 includes longitudinally-spaced-apart projections 89*a*, 89*b* that extend outwardly therefrom. Projection 56 of outer shell 32 can fit between projections 89*a*, 89*b* to provide a positive position-retaining feature between outer shell 32 and inner shell 34. A fourth position-retaining feature 90 is spaced longitudinally-upwardly from third position-retaining feature 88, and includes longitudinally-spaced-apart projections 91*a*, 91*b* that extend outwardly from outer surface 64. Upper projection 91*a* extends entirely around outer surface 64. Projection 56 of outer shell 32 may be disposed between projections 91*a*, 91*b* to provide a fourth positively-retained position of outer shell 32 relative to inner shell 34.

A projection 94 extends along upper edge 66 and extends outwardly from outer surface 64. Four flexible fingers 96 are disposed along the upper portion 58 of inner shell 34 between longitudinally-extending slots 97. Fingers 96 extend outwardly from outer surface 64 as they extend upwardly. Upper portions 98 of fingers 96 extend outwardly beyond projection 94 and engage with inner surface 54 of outer shell 32 such that they push outwardly on inner surface 54, as shown in FIG. 10A. Fingers 96 are dimensioned to engage with inner surface 54 in most positions. That is, the tapering of inner surface 54 causes the position of inner surface 54 relative to fingers 96 to change as outer shell 32 is moved relative to inner shell 34. As a result, upper portions 98 of fingers 96 provide varying degrees of push or contact with inner surface 54. When outer shell 32 is positioned in its lower-most position relative to inner shell 34, such as shown in FIG. 1, fingers 96 do not contact inner surface 54. Rather, a small clearance is provided therein such that fingers 96 are in a relaxed state in this position. In other positions, fingers 96 are flexed inwardly and provide an outward push or force against inner surface 54. Fingers 96 thereby provide a desired feel and supplement the feel or fit between outer shell 32 and inner shell 34 provided by the engagement between ribs 74 and projection 56. Engagement of fingers 96 with inner surface 54 of outer shell 32 helps to center outer shell 32 relative to inner shell 34.

Figure 4:
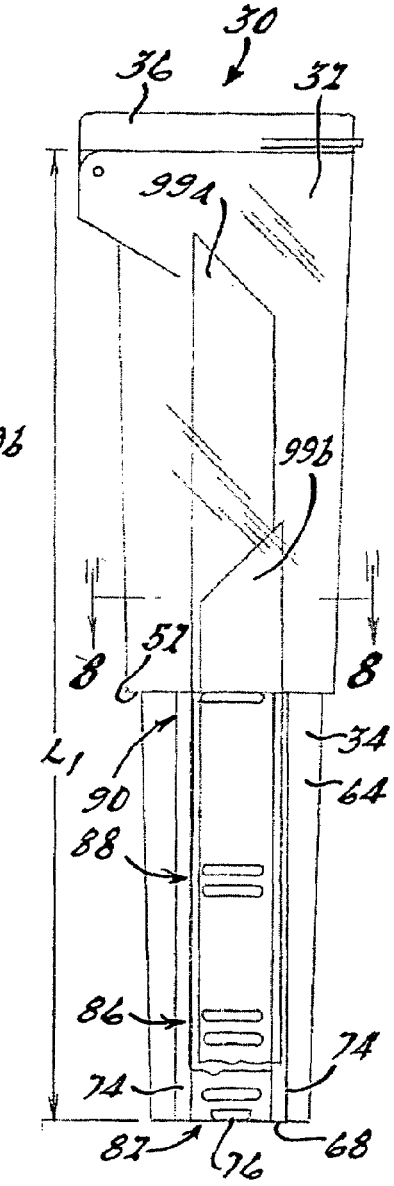
Figure 5:
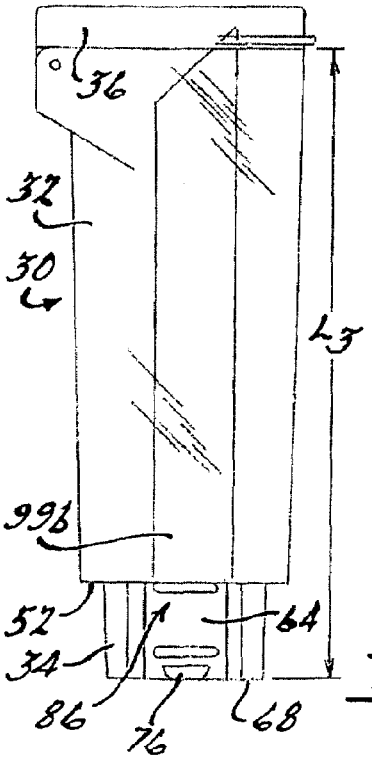
Figure 9:
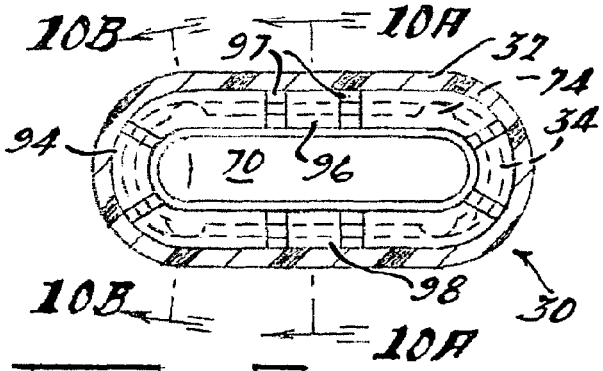
FIG. 9 is a cross-sectional view along line 9-9 of FIG. 5.
Figure 9:
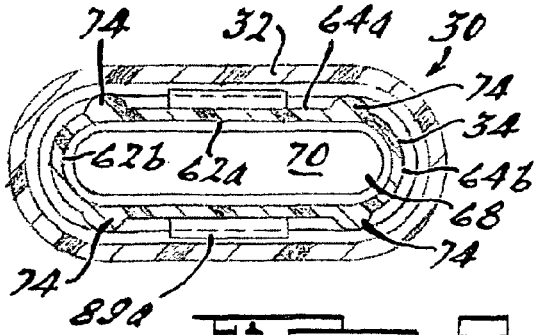

Referring now to FIGS. 4-7, storage case 30 is shown in its various operational positions. Outer shell 32 and inner shell 34 are movable relative to one another to telescopically extend or increase the length L of storage case 30. The length L of storage case 30 is defined as the longitudinal distance between top edge 50 of outer shell 32 and bottom 68 of inner shell 34. The ability to change the length of storage case 30 facilitates the storage of accessories therein of varying lengths, such as long and short saw blades 99*a*, 99*b* and those shown in FIG. 23. Storage case 30 can be positioned with projection 56 of outer shell 32 disposed within the fourth position-retaining feature 90, thereby providing the largest length $L_1$ of storage case 30, as shown in FIG. 4. With storage case 30 at length $L_1$, the long and short accessories can both be disposed within the interior cavity 70. Storage case 30 is dimensioned so that $L_1$ corresponds to the ability of storage case 30 to stow the longest accessory for which it is intended. Lid 36 can be opened to allow access to the accessories within storage case 30. If desired, outer shell 32 can be moved relative to the inner shell 34 so that projection 56 disengages from fourth position-retaining feature 90 and engages with third position-retaining feature 88, as shown in FIG. 5. In this position, storage case 30 has a length $L_2$, which is less than length $L_1$. In this position, the longer saw blade 99*a* protrudes upwardly beyond top edge 50 of outer shell 32. Saw blade 99*a* can then be easily grasped and removed from storage case 30.

Outer shell 32 can be further moved relative to inner shell 34 so that projection 56 disengages from third position-retaining feature 88 and engages with second position-retaining feature 86, as shown in FIG. 6. In this position, storage case 30 has a length $L_3$ which is less than length $L_2$. Storage case 30 can be designed so that length $L_3$ corresponds to the ability to retain the shorter accessory, such as short saw blade 99*b*, therein with lid 36 closed. Lid 36 can be opened to allow access to saw blade 99*b* therein. If desired, outer shell 32 can be further moved relative to inner shell 34 such that projection 56 disengages from second position-retaining feature 86 and engages with first position-retaining feature 82, as shown in FIG. 7. In this position, storage case 30 has a length $L_4$ which is less than length $L_3$. $L_4$ also corresponds to the shortest length for storage case 30. Storage case 30 can be dimensioned so that length $L_4$ corresponds to the shorter accessory extending upwardly beyond top edge 50 of outer shell 32. Access to the short accessory, such as saw blade 99*b*, is thereby facilitated and can be easily removed therefrom.

Movement of storage case 30 between length $L_1$ and length $L_4$ is facilitated by the flexible nature of outer shell 32 and inner shell 34. That is, the flexible nature allows projection 56 to be engaged and disengaged with the position-retaining features by the application of the appropriate force between inner and outer shells 34, 32.

Storage case 30 can be dimensioned so that the position-retaining features correspond to the desired lengths at which storage-case 30 is intended to be operated. For example, the position-retaining features can be disposed at locations that correspond to the various lengths of the intended accessories to be disposed therein. Alternatively, the positioning-retaining features can be disposed at uniform intervals along inner shell 34 to provide various distinct, positively-retained positions to facilitate the use of storage case 30 with accessories that may not have discreet or uniform variations in length. The number of positive-retaining features can be increased or decreased from that shown, as desired.

Inner and outer shells 34, 32 can be made from a variety of materials that facilitate the assembly and operation thereof. By way of non-limiting example, inner and outer shells 34, 32 can be made from polycarbonate, glass-filled polymers, ABS, polypropylene, and the like. These materials may be capable of withstanding impacts associated with the potential dropping of storage case 30. The materials may also be resilient/flexible thereby facilitating the use of the detent, projections and retaining features disclosed therein. Moreover, these materials may also have good temperature-resistance so that they are not excessively brittle when cold nor subject to excessive warping when exposed to heat. Furthermore, the materials exhibit resistance to oil, grease, lubricants, drill oils, and other fluids with which storage case 30 may come in contact. Shells 32, 34 may be transparent, translucent or opaque. Transparent and translucent shells may advantageously allow a user to see the accessories that are contained therein without opening the storage case.

Storage case 30 may be provided with one or more vent holes or be designed with clearances that allow air to flow into and exit from storage case 30. The allowance of air to go in and out of the cavity facilitates the telescopic movement of the storage case 30 when lid 36 is closed. If desired, storage case 30 can be provided as a weather-tight container such that fluids do not easily enter into or leave storage case 30. When storage case 30 is weather-tight, lid 36 may need to be open when extending or retracting storage case 30. Providing a weather-tight storage case 30 can be facilitated by the use of gaskets, over-molding the inside of lid 36 and using a sealing material, and positioning a sealing material between inner and outer shells 34, 32. Optionally, the interior of storage case 30 can be partitioned by one or more partition walls (not shown). Moreover, a horizontal partition may be disposed within inner shell 34 with vertically-extending openings therein. The openings can be configured to retain specific accessories, such as circular openings for retaining drill bits of various sizes therein.

Referring now to FIGS. 11-14, another storage case 130 according to the present teachings is shown. Storage case 130 includes a longitudinally-extending elongated body member 132, a base member 134, a lid member 136, and two removable panels 138. Body member 132 includes opposite walls 140, 142 and a web 144 extending therebetween the entire longitudinal length of walls 140, 142. Web 144 is generally perpendicular to walls 140, 142 and is integral therewith. A pair of laterally-extending projections 146, 148 extends along each wall 140, 142 adjacent the longitudinal side edges and forms a longitudinally-extending channel 150 therebetween. Each wall 140, 142 has two channels 150 that oppose corresponding channels 150 on the opposite wall. These opposing channels retain panels 138 therein.

Panels 138 include upper and lower edges 152, 154 and longitudinal-extending sides edges 156 therebetween. Panels 138 have a thickness that is slightly less than the space between projections 146, 148 of each channel 150, thereby enabling removable panels 138 to longitudinally slide within channels 150. Panels 138, first and second walls 140, 142 and web 144 define first and second compartments 158, 160 within which the accessories may be stored, such as saw blades 99*a*, 99*b* and those shown in FIG. 23.

Panels 138 may be transparent to allow a user to see the accessories that are disposed within compartments 158, 160.

As such, panels 138 may be made from polycarbonate or the like. If desired, panels 138 can be translucent.

Base 134 is fixedly attached to the lower end of body member 132 and forms a fixed bottom for compartments 158, 160. Lid 136 covers the tops of compartments 158, 160 and has two portions each movable between open and closed positions. In the closed position, lid 136 prevents the longitudinal movement of panels 138 relative to body member 132. In the open position, panels 138 may be longitudinally moved relative to body member 132. A first portion 164 of lid 136 covers first compartment 158, while a second portion 166 of lid 136 covers second compartment 160 when in the closed position. First and second portions 164, 166 are separated by a living hinge 168. Hinge 168 allows first and second portions 164, 166 to be pivoted about hinge 168 between the open and closed positions. Lid 136 includes two downwardly-projecting extensions 170, 172 that form a channel 174 therebetween, which is disposed over web 144 of body member 132. Extensions 170, 172 and living hinge 168 are positioned on lid 136 so that living hinge 168 is directly above and extends along the top edge of web 144.

Each portion 164, 166 of lid 136 also includes a downwardly-extending rectangular projection 176 having a surface 178 that engages against projections 148 to retain portions 164, 166 in the closed position. Projection 176 and surface 178 are flexible, thereby allowing deformation of projection 176 when engaging with projections 148. The engagement provides a retaining force that inhibits the inadvertent opening of lid 136. The side edge 180 of lid 136 extends laterally outwardly beyond body member 132. This outward extension facilitates the gripping of each portion 164, 166 of lid 136, and the opening and closing thereof.

When lid 136 is in an open position, accessories, such as those discussed above and shown in FIG. 23, may be inserted into compartments 158, 160 by dropping or sliding the accessories through the opening covered by lid 136. Alternatively, panels 138 can be slid longitudinally to allow access to the associated compartment and the accessories positioned therein. With the accessories disposed in the compartment, panels 138 can then be slid longitudinally to their closed position and lid 136 closed. To remove the accessories, lid 136 can be opened and panels 138 longitudinally-slid relative to body member 132. Access to the accessories therein can then be achieved without the necessity of dumping out the accessories through the top opening. This accessibility to the compartment 158, 160 facilitates the removal of accessories of various lengths, especially when mixed together within the same compartment. That is, a shorter accessory can be accessed without the necessity of removing a longer accessory within a compartment due to the longitudinal accessibility of the compartments.

Body member 132, lid member 136 and base member 134 may be made from a variety of materials. For example, these members may be made from ABS, polypropylene, glass-filled polymers and the like. While base member 134 is shown as being a solid member that is fixedly attached to body member 132, it should be appreciated that a second lid member can be utilized in lieu of base member 134, thereby forming a storage case 130 having operable lid members at each end thereof.

Referring now to FIGS. 16-19, another storage case 230 for storing accessories, such as those shown in FIG. 23 and discussed above, according to the present teachings is shown. Storage case 230 includes a body member 232 and two flexible panels 234, 236 disposed on opposing sides thereof. Panels 234, 236 can be pivoted about integral hinges therein to allow variable degrees of access to accessories stowed within storage case 230, as described below.

Body member 232 includes laterally spaced-apart, longitudinally-extending side walls 238, 240 with a web 242 extending therebetween. A top edge 244 of body member 232 is covered by panels 234, 236 when in the closed position. A lower end of body member 232 includes a base or bottom surface 246. Side walls 238, 240, web 242, bottom surface 246 and panels 234, 236 define first and second compartments 248, 250 of storage case 230 within which the accessories of varying lengths can be disposed, such as saw blades 299*a*, 299*b*.

Each panel 234, 236 includes a laterally-extending top portion 252 and a longitudinally-extending main portion 254. Top portion 252 extends orthogonally from main portion 254 and covers top edge 244 of body member 232 when panels 234, 236 are in the closed position. Main portion 254 includes two living hinges 256, 258. Upper living hinge 256 separates an upper main portion 260 from an intermediate main portion 262 while lower living hinge 258 separates intermediate main portion 262 from lower main portion 264. Lower main portion 264 is fixedly attached (i.e., not intended to be removed) to side walls 238, 240 and bottom surface 246 of body member 232 while upper and intermediate main portions 260, 262 are not fixedly attached thereto. Lower main portion 264 may be fixedly attached to body member 232 through the use of adhesives, pawls, detents or other interlocking features.

Projections 266 laterally extend from intermediate main portion 262 and include a recess 268 therein. Similarly, projections 270 laterally extend from upper main portion 260 and also include a recess 272 therein. Side walls 238, 240 of body member 232 each include lower and upper projections 274, 276 that extend toward one another and engage with the respective recesses 268, 272 of projections 266, 270 on panels 234, 236. The engagement retains the associated portion of panels 234, 236 in the closed position.

Figure 17:
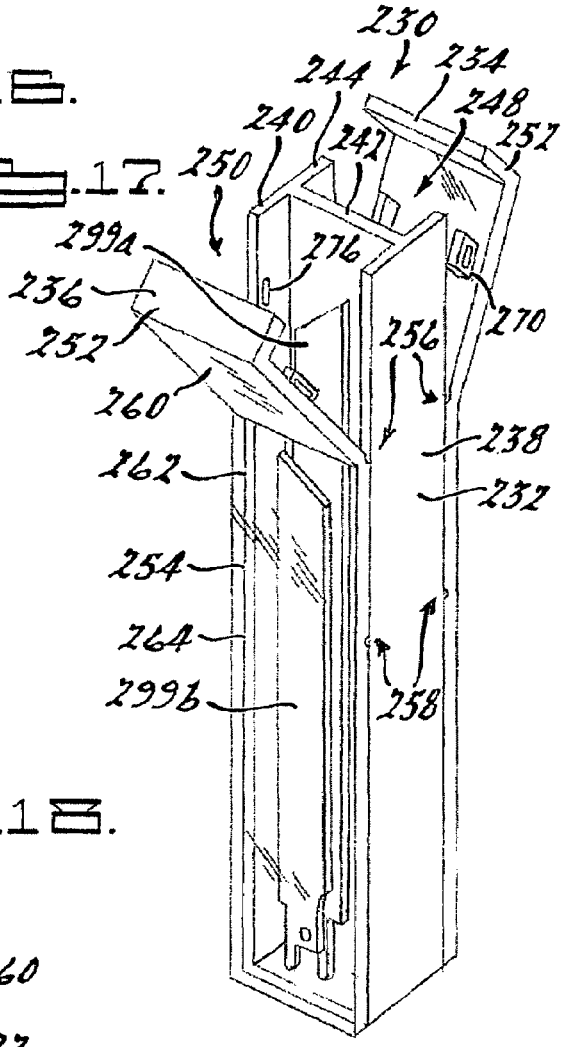
FIG. 17 is a perspective view of the storage case of FIG. 16 with the panels in a first open position.
Figure 18:
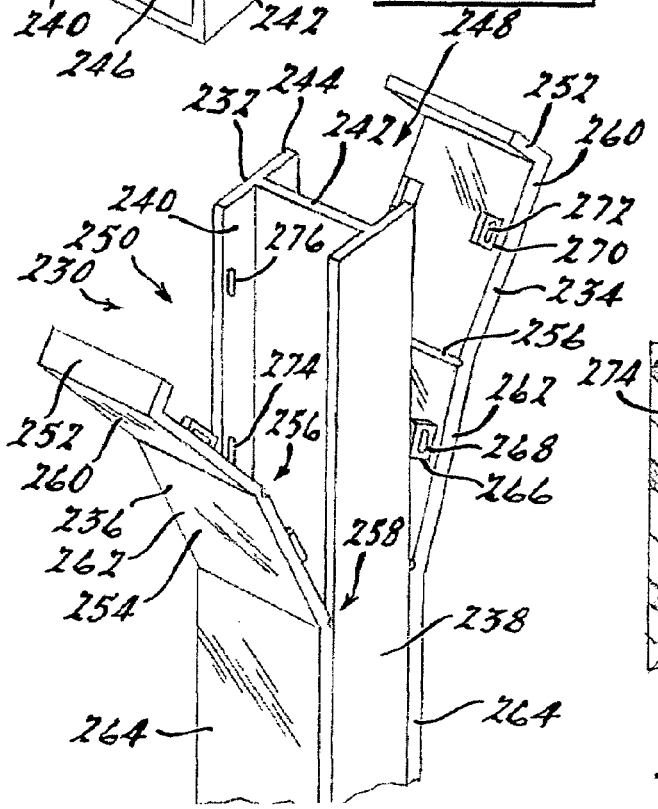
FIG. 18 is a partial perspective view of the storage case of FIG. 16 with the panels in a second open position.
Figure 19:
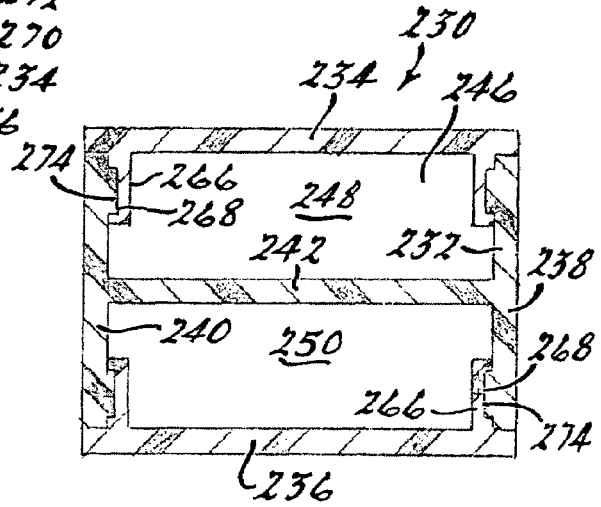
FIG. 19 is a cross-sectional view along line 19-19 of FIG. 16.

In operation, each panel 234, 236 can be independently operated to allow access to first and second compartments 248, 250. Panels 234, 236 can open to a first position wherein upper main portions 260 are pivoted about upper living hinge 256 to allow limited access to first and second compartments 248, 250, as shown in FIG. 17. By applying a sufficient force to upper main portions 260, the engagement between upper projections 276 of body member 232 with recesses 272 of projections 270 on upper main portions 260 may be overcome and allow upper main portions 260 to pivot about upper living hinge 256. If additional access to compartments 248, 250 is desired, further force can be applied to upper main portions 260 to overcome the engagement between lower projections 274 of body member 232 with recesses 268 in projections 266 on intermediate main portions 262. When a sufficient force is applied, intermediate main portion 262 pivots about lower living hinge 258, as shown in FIG. 18, to thereby increase the access to compartments 248, 250. The increased accessibility enables a user to access the smaller accessories, such as short saw blades 299*b* therein without the necessity of dumping the contents from storage case 230.

Body member 232 and panels 234, 236 can be made from a variety of materials. For example, body member 232 may be made from polycarbonate, glass-filled polymers, ABS, polypropylene and the like. Some of the materials that are suitable for body members 232, such as polycarbonate, may not be suitable for panels 234, 236 due to the presence of living hinges. Panels 234, 236 may be made from polypropylene.

While lower main portions 264 of panels 234, 236 are shown as being fixedly attached to body member 232, it should be appreciated that changes can be made to this portion of the panels without deviating from the scope of the present teachings. For example, lower main portions 264 can be configured to also open and close relative to body member 232 about one or more living hinges, such as lower living hinge 258. When this is the case, positive retaining features, such as the projections and recesses discussed above may also be utilized. This configuration allows access to compartments 248, 250 from the top and bottom. Moreover, it should also be appreciated that panels 234, 236 can be integrally formed into a single unitary component with a bottom wall or surface (not shown) interconnecting the two panels and extending over bottom surface 246 of body member 232. In this manner, the number of components utilized to form storage case 230 is reduced. If desired, panels 234, 236 and/or body member 232 may be transparent, translucent or opaque. The use of translucent or transparent material enables a user to see the accessories stored within compartments 248, 250 without requiring the opening of panels 234, 236.

Referring now to FIGS. 20-22, another storage case 330 according to the present teachings is shown. Storage case 330 provides two segregated storage compartments for accessories, such as those shown in FIG. 23 and discussed above, to be stowed therein. Storage case 330 includes a body member 332 and two pivotal panels 334, 336 that are pivotal between open and closed positions to allow access to the storage compartments therein.

Body member 332 is a single integral piece and includes, in the orientation of the views depicted, upper and lower vertical walls or portions 342, 344 interconnected by a horizontal wall or portion 346 thereby forming a "Z" shaped cross section. Body member 332 also includes opposite spaced-apart end walls 348, 350 between which walls 342, 344, 346 extend. Each end wall 348, 350 has two apertures 352, therein to facilitate pivotal connection of panels 334, 336 to body member 332.

Each panel 334, 336 includes a base wall 358 and an enclosing wall 360 extending orthogonally from an edge thereof. Panels 334, 336 also include opposite end walls 362, 364 that extend along an entire end edge of base wall 358 and a portion of the edge of enclosing wall 360. A projection 366 extends outwardly from each end wall 362, 364 and resides within apertures 352 of end walls 348, 350 of body member 232. The engagement of projections 366 within apertures 352 allows panels 334, 336 to be pivotally rotated between open and closed positions relative to body member 332. For example, as shown in FIGS. 21 and 22, panel 334 is in an open position while panel 336 is in the closed position, with the open position being shown in phantom in FIG. 22. Body member 332 and panels 334, 336 define first and second storage compartments 370, 372. Compartments 370, 372 are vertically spaced apart in the orientation shown in the figures and separated by wall 346 of body member 332. When in the closed position, a portion of enclosing wall 360 of panels 334, 336 resides against the respective walls 342, 344 while base wall 358 is substantially parallel with and spaced apart from wall 346.

To move panels 334, 336 between the closed positions, shown in FIG. 20, to an open position, such as that shown in FIGS. 21 and 22, the panels are rotated relative to body member 332 about projections 366. When in the open position, access to compartments 370, 372 is facilitated. The access opening extends along the entire length of panel 334, 336 thereby allowing the insertion and removal of accessories of varying lengths, such as saw blades 399, without the necessity of dumping all of the accessories out. Panels 334, 336 can be provided with projections (not shown) that engage with recesses (not shown) and end walls 348, 350 of body member 332 to provide a positive retaining feature to retain panels 334, 336 in the closed position. Alternatively, other types of releasable retaining features may be employed.

Panels 334, 336 may be transparent or translucent to allow the user to see the accessories disposed within compartments 370, 372 without requiring the opening of panels 334, 336. As such, panels 334, 336 may be made from a variety of materials including polycarbonate, polypropylene and the like. Body member 332 may also be made from a variety of materials, such as polycarbonate, glass-filled polymers, ABS, polypropylene and the like.

While the present teachings have been described with reference to the drawings and examples, changes may be made without deviating from the spirit and scope of the present teachings. For example, each of the storage cases disclosed herein may include a belt loop or clip or other type of retaining devices to facilitate the retaining of the storage container on the person or other object. Additionally, while specific projections and recesses form the retaining features that are shown, it should be appreciated that other types of positive retaining features may be employed. For example, flexible fingers and recesses may be used, as well as spring-loaded balls and the like. Additionally, each of the storage cases may be provided as a weather-tight or fluid-tight storage case. That is, through the use of appropriate gaskets, overmolding and inclusion of sealing material therein, and the like can be utilized to provide a weather-tight enclosure to store the accessories therein. Additionally, while the accessories are shown by way of reference to specific accessories, such as drill bits, saw blades and screwdriver bits, it should be appreciate that other accessories may be stored within the storage cases herein and still be within the scope of the present teachings. Moreover, the storage case may be included as part of a kit that includes various accessories in a variety of sizes that are package together with the storage case and sold as a kit. When this is done, the transparent or translucent nature of the outer cover facilitates a purchaser seeing the storage case and the accessories that are contained therein thereby providing a desirable packaging appearance. Accordingly, the description is merely exemplary in nature and variations are not to be regarded as a departure from the spirit and scope of the teachings.

What is claimed is:

1. A telescopic storage case comprising:

a longitudinal axis;

a first longitudinally extending shell having an interior surface defining an interior cavity;

a second longitudinally extending shell having a bottom and opposite inner and outer surfaces defining a side wall therebetween that extends longitudinally from said bottom, said inner surface and said bottom defining an interior cavity of said second shell, a first portion of said second shell continuously disposed in said first shell interior cavity, and said second shell being longitudinally movable relative to said first shell over a predetermined distance;

a plurality of position retaining features releasably limiting relative longitudinal movement between said first and second shells;

a plurality of longitudinally extending ribs disposed on at least one of said outer surface of said second shell and said interior surface of said first shell, at least one of said ribs being engaged with the other of said outer surface of said second shell and said interior surface of said first shell regardless of a longitudinal position of said second shell relative to said first shell.

2. The storage case of claim 1, wherein a second portion of said second shell has a wall thickness between said interior and exterior surfaces that is substantially uniform, said second portion wall tapers as said second portion wall extends longitudinally from said bottom surface, said ribs extend longitudinally along said outer surface of said second portion, and said ribs define a constant exterior dimension of said second portion of said second shell as said ribs extend longitudinally along said outer surface.

3. The storage case of claim 2, wherein said plurality of ribs are at least four ribs spaced apart along flat portions said outer surface.

4. The storage case of claim 2, wherein said second portion is a majority portion of said second shell.

5. The storage case of claim 1, wherein at least one of said plurality of position retaining features is disposed on said outer surface of said second shell and further comprising an inwardly extending projection on said interior surface of said first shell that releasably engages with said at least one position retaining feature on said outer surface of said second shell to limit relative longitudinal movement between said first and second shells.

6. The storage case of claim 5, wherein said projection on said interior surface of said first shell engages with at least one of said ribs.

7. The storage case of claim 1, wherein a lowermost one of said position retaining features prevents removal of said second shell from said first shell.

8. The storage case of claim 1, further comprising a plurality of flexible finger members on said second shell, said finger members applying an outward force on said interior surface of said first shell during a portion of relative movement between said first and second shells over said predetermined distance.

9. The storage case of claim 1, further comprising a lid pivotally coupled to said first shell and moveable between open and closed positions to allow access to said first shell interior cavity.

10. The storage case of claim 1, wherein said ribs extend longitudinally along a majority portion of at least one of said outer surface of said second shell and said interior surface of said first shell.

11. The storage case of claim 1, wherein said ribs extend longitudinally from an end portion of at least one of said outer surface of said second shell and said interior surface of said first shell.

12. The storage of claim 1, wherein said ribs have a longitudinal dimension greater than a transverse dimension.

13. A storage case comprising:

a first elongated member having a longitudinally extending interior cavity;

a second elongated member having a longitudinally extending interior cavity and spaced apart first and second ends, a portion of said second member continuously disposed in said first member interior cavity with said interior cavities of said first and second members generally aligned, and said second member being longitudinally moveable relative to said first member over a predetermined distance to vary a storage capacity;

a plurality of flexible cantilevered finger members adjacent one of said ends of said second member, said finger members engaging with and applying an outward force on said first member during a portion of relative movement between said first and second members over said predetermined distance.

14. The storage case of claim 13, wherein said finger members are disengaged from said first member during a different portion of relative movement between said first and second members over said predetermined distance.

15. The storage case of claim 13, wherein said first end of said second member is an open end and forms an opening to said second member interior cavity, said second end of said second member is a closed end, said finger members are adjacent said first end of said second member, and said first end of said second member is continuously disposed in said interior cavity of said first member.

16. The storage case of claim 15, wherein said second member has a side wall extending between said open and closed ends and defines said interior cavity of said second member and a plurality of slots in said side wall extend longitudinally from said open end toward said closed end, and each of said finger members is disposed between a pair of adjacent ones of said slots.

17. The storage case of claim 16, wherein said finger members extend laterally outwardly from said side wall to engage with said first member.

18. The storage case of claim 13, further comprising a plurality of outwardly extending ribs extending longitudinally along an exterior of said second member and at least one of said ribs being engaged with said first member regardless of a longitudinal position of said second member relative to said first member.

19. The storage case of claim 18, wherein said ribs define a constant exterior dimension of said second member along a portion of a longitudinal length of said second member.

20. The storage case of claim 13, further comprising a lid pivotally coupled to said first member and moveable between open and closed positions to allow access to said generally aligned cavities.

21. The storage case of claim 13, wherein each one of the plurality of finger members is longitudinally cantilevered.

22. The storage case of claim 13, wherein each one of the plurality of finger members has a longitudinal dimension greater than a transverse dimension.

23. The storage case of claim 13, wherein each one of the plurality of cantilevered finger members is flexible in a direction corresponding to flexing into and away from said second member interior cavity.

* * * * *